US005209070A

United States Patent [19]

Darredeau

[11] Patent Number: 5,209,070

[45] Date of Patent: May 11, 1993

[54] PROCESS AND ARRANGEMENT FOR THE DISTILLATION OF AIR IN THE PRODUCTION OF GASEOUS OXYGEN UNDER VARIABLE OPERATING CONDITIONS

[75] Inventor: Bernard Darredeau, Sartrouville, France

[73] Assignee: L'Air Liquide, Societe Anonyme Pour l'Etude et l'Exploitation des Procedes Georges Claude, Paris, France

[21] Appl. No.: 801,731

[22] Filed: Dec. 3, 1991

[30] Foreign Application Priority Data

Dec. 6, 1990 [FR] France ..... 90 15294

[51] Int. Cl.[5] ..... F25J 3/00

[52] U.S. Cl. ..... 62/11; 62/37; 62/40

[58] Field of Search ..... 62/11, 40, 37

[56] References Cited

U.S. PATENT DOCUMENTS

| | | | |
|---|---|---|---|
| 4,303,428 | 12/1981 | Vandenbussche | 62/13 |
| 4,668,260 | 5/1987 | Yoshino | 62/11 |
| 4,698,079 | 10/1987 | Yoshino | 62/11 |
| 4,731,102 | 3/1988 | Yoshino | 62/40 |
| 4,732,595 | 3/1988 | Yoshino | 62/11 |
| 5,084,081 | 1/1992 | Rohde | 62/40 |
| 5,144,428 | 8/1992 | Frenzel et al. | 62/40 |

FOREIGN PATENT DOCUMENTS 0399197 4/1990 European Pat. Off. .

OTHER PUBLICATIONS

"Luftzerlegungsanlage mit Wechselspeicherung fur variable Sauerstofflieferung," Linde Berichte Aus Technik Und Wissenschaft, vol. 54 (1984), pp. 18-20.

*Primary Examiner*—Ronald C. Capossela
*Attorney, Agent, or Firm*—Curtis, Morris & Safford

[57] ABSTRACT

This process is of the alternating type. When the demand of oxygen is lower than the mean value, additional liquid oxygen is produced by introducing compressed oxygen, in gaseous form, in the heat exchange line of the arrangement, the flow of liquid nitrogen injected into the double column being reduced in a corresponding manner. It is thus possible to increase the average yield of the arrangement when extracting argon.

9 Claims, 1 Drawing Sheet

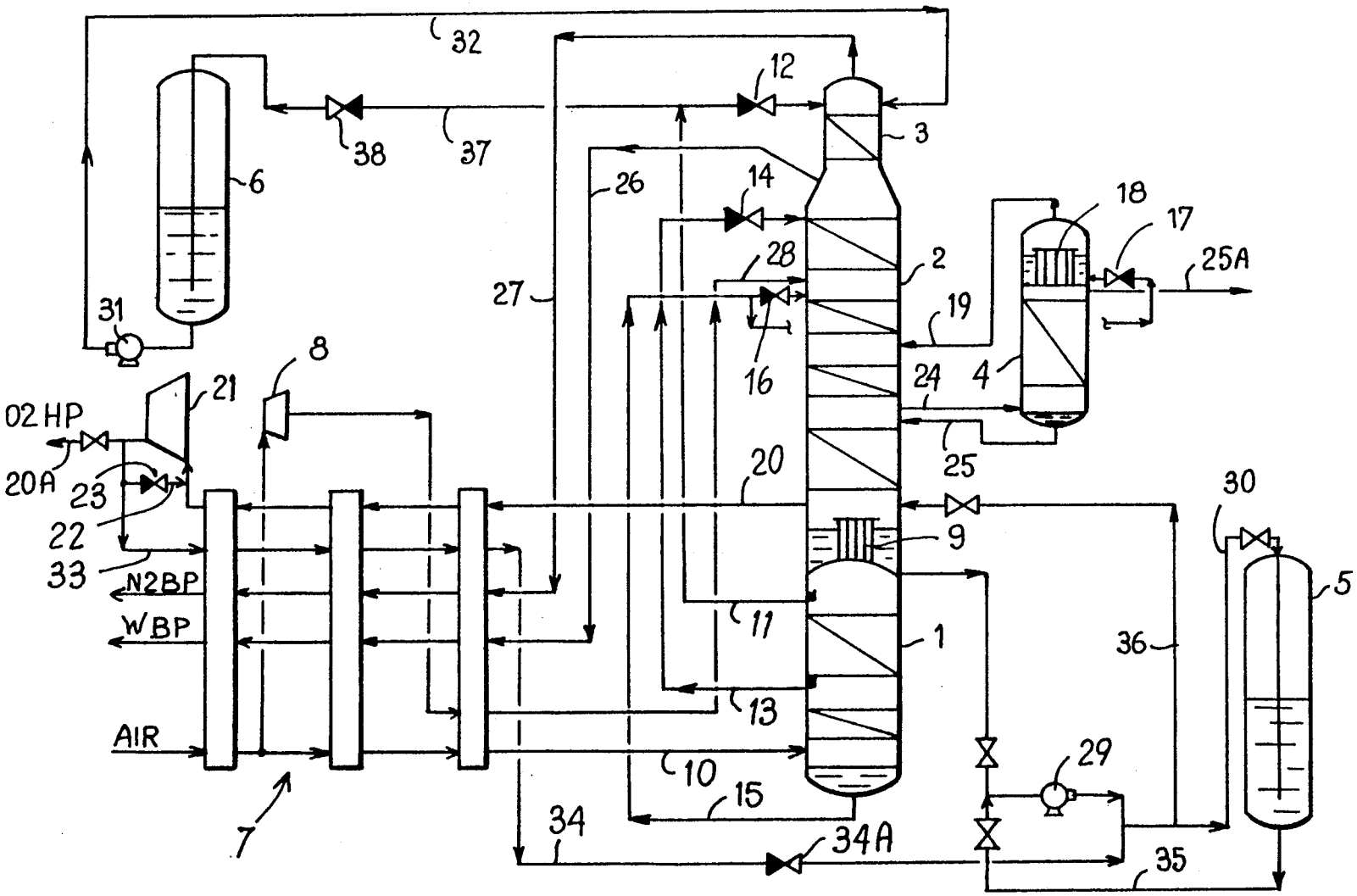
AIR
WBP
N2BP
O2HP

PROCESS AND ARRANGEMENT FOR THE DISTILLATION OF AIR IN THE PRODUCTION OF GASEOUS OXYGEN UNDER VARIABLE OPERATING CONDITIONS

BACKGROUND OF THE INVENTION (a) Field of the Invention

The present invention relates to the technique for the distillation of air in the production of gaseous oxygen under variable operating conditions, by means of an arrangement provided with a double column. It mainly concerns a process of the type in which, when the demand of gaseous oxygen is lower than an average value, liquid oxygen is allowed to pass from the low pressure column of the double column into a first container for storing liquid oxygen and liquid nitrogen originating from a second storage container for liquid nitrogen is sent to the double column, whilst when the demand of gaseous oxygen is higher than the average value, liquid oxygen withdrawn from the first storage container is introduced into the low pressure column and a corresponding quantity of liquid nitrogen is condensed simultaneously, said liquid nitrogen being sent to the second storage container.

(b) Description of Prior Art

The process of this type are generally called "aternating". A distinction is made between two different operations of the arrangement:

(a) when the demand of gaseous oxygen is high, the excess of gaseous oxygen which is withdrawn from the low pressure column is compensated, on a point of view of balance of material by an injection, into this column, of a corresponding quantity of liquid oxygen which originates from the first storage container. To equilibrate the refrigerating balance of the double column, a corresponding quantity of liquid nitrogen is sent from the mean pressure column to the second storage container. For this reason, this operation is generally called "operation NL", and this is the designation which will be used hereinafter.

(b) When the demand of gaseous oxygen is low, the lack of oxygen with respect to the nominal operation is sent in liquid form from the low pressure column to the first storage container (from which the expression "operation OL" which will often be used). The refrigerating balance is obtained by injection into the low pressure column of a corresponding quantity of liquid nitrogen which originates from the second storage container.

When the arrangement includes a column for the production of impure argon coupled to the low pressure column, this alternating principle is not without influence on the yield of extraction of argon. As a matter of fact:

(a) in operation NL, it is easy to realize that the vapor/liquid ratio decreases in the lower portion of the low pressure column, which is detrimental to the oxygen/argon separation that takes place in this zone, and therefore to the yield of extraction of argon.

There is obviously another phenomenon which acts in reversed direction: the vaporisation of additional liquid oxygen condenses a higher quantity of nitrogen at the top of the mean pressure column since the heat of vaporisation of nitrogen is about 20% lower than that of oxygen. There is therefore a deficit of gaseous products which is sent to the cold end of the heat exchanger line of the arrangement, which closes the heat exchange diagram towards the hot end and results in an increase of the suction temperature of the turbine which is generally used to keep the arrangement cold. This turbine has an increased specific refrigerating power, which enables to decrease the flow produced by the turbine. However, this favorable phenomenon is truly less important than the unfavorable phenomenon mentioned above consisting of a reduction of the vapor/liquid ratio. In all, the operation NL is thus unfavorable to the yield of extraction of argon.

(b) In operation OL, the reverse takes place, for similar reasons: on the other hand, the vapor/liquid ratio increases at the bottom of the low pressure column, and on the other hand, the suction temperature of the turbine decreases, which requires to increase the flow of gas produced by the turbine. In all, this operation OL promotes the yield of extraction of argon.

(c) Unfortunately, the increase in the yield of extraction of argon obtained in OL operation is less important than the loss of yield of extraction of argon which takes place in operation NL, since the yield corresponding to the nominal operation is generally high and already near an asymptote. The result is that if, and this will be the basic hypothesis, the nominal operation corresponds to the mean production of oxygen in the arrangement, then the alternating process lowers the mean yield during the extraction of argon.

SUMMARY OF INVENTION

The invention aims at enabling to improve the mean yield of argon, and/or, as a variant, to increase a production of liquid by the arrangement, in an alternating process.

For this purpose, it is an object of the invention to provide a process of the type mentioned above, characterized in that when the demand of oxygen is lower than the mean value, additional liquid oxygen is produced by introducing compressed oxygen in gaseous state in the heat exchange line of the arrangement, the flow of liquid nitrogen injected into the double column being reduced in a corresponding manner.

According to other characteristics:

when the demand of gaseous oxygen is higher than the mean value, the liquid nitrogen which has been saved when the demand of oxygen is lower than the mean value is sent to the double column;

when the arrangement comprises a main turbine for preserving cold conditions during the periods where the demand of gaseous oxygen is higher (respectively lower) than the mean value, the flow of the main turbine with respect to the nominal flow is reduced (respectively increased).

It is also an object of the invention to provide an arrangement for the distillation of air and which is intended to carry out the process defined above. This arrangement, of the type comprising a heat exchange line, an alternater which includes a first storage container for liquid oxygen connected to the low pressure column and a second storage container for an auxiliary liquid connected to the double column, and a utilisation duct supplying gaseous oxygen under high pressure, is characterized in that it contains a duct for the return to the heat exchange line of a variable flow of gaseous oxygen under high pressure which is withdrawn from a utilisation duct, this return duct being connected to said first storage container.

BRIEF DESCRIPTION OF DRAWINGS

An embodiment of the invention will now be described with reference to the annexed drawings, in which the single figure is a schematic illustration of an arrangement for the distillation of air according to the invention.

DESCRIPTION OF PREFERRED EMBODIMENTS

The arrangement for air distillation illustrated in the drawing is adapted to supply a variable quantity of gaseous oxygen under high pressure (which, for example, could be as high as up to about 15 bars) as well as argon. It is of the type including a double column with a minaret and a column production of impure argon, with expanded air and oxygen/nitrogen alternater.

Thus the arrangement essentially comprises a mean pressure column 1 surmounted by a low pressure column 2 which is provided with a minaret 3 at the top thereof, a column 4 for the production of impure argon, a first storage container 5 for liquid oxygen, a second storage container 6 for liquid nitrogen, a heat exchange line 7 and a turbine 8 for expanding air from mean pressure to low pressure. Typically, the mean pressure is at about 6 bars absolute and the low pressure is slightly higher than atmospheric pressure. The vapor (nitrogen) in the top part of the column 1 is placed in indirect heat exchange relationship with the liquid (oxygen) in the vat portion of the column 2 by means of a main vaporiser-condenser 9.

The nominal operation for the production of gaseous oxygen of the arrangement will first be described.

The air to be separated, from which water and carbon dioxide have to be removed, which is compressed at about 6 bars absolute and cooled at the vicinity of its dew point in the heat exchange line 7, is introduced at the bottom of the column 1 by means of a duct 10. Poor liquid from the upper portion, consisting of nearly pure nitrogen, is withdrawn from the top of column 1 via duct 11, sub-cooled in a non-illustrated sub-cooler, expanded in a pressure release valve 12 and refluxed at the top of minaret 3 of the low pressure column.

Poor liquid from the lower portion, which is withdrawn at an intermediate level of column 1 by means of duct 13, is sub-cooled in the above mentioned sub-cooler, expanded in a pressure release valve 14 and sent under reflux into column 2 at a level corresponding to the base of the minaret 3.

Rich liquid, consisting of oxygen enriched air and which is withdrawn from the vat portion of column 1 by means of duct 15, is sub-cooled in the above-mentioned sub-cooler. A portion of this liquid, which is expanded in a pressure release valve 16, is sent under reflux into column 2, and the remaining portion is expanded in a pressure release valve 17 after which it is sent to the upper condenser 18 of column 4 to be vaporised therein, and then it is sent into column 2 via duct 19. The gaseous oxygen produced is withdrawn at the base of column 2 via duct 20, heated from the cold end to the hot end of the exchange line 7 and then compressed at elevated pressure by means of a compressor 21 backflowing into a utilisation duct 20A supplying the high pressure oxygen required. This compressor includes a duct 22 for recycling from its outlet to its suction side, said duct being provided with a pressure release valve 23, so as to enable to provide flows of high pressure gaseous oxygen which are very different from one another, in spite of the limited flexibility of the compressor.

Column 4 is supplied at the base thereof by means of a vapor which is withdrawn at an intermediate level of the column 2 by means of a duct 24, so called argon bleeding. The vat liquid returns into column 2, substantially at the same level, via a duct 25. The impure argon produced is withdrawn from the top of the column 4 via duct 25A.

Also illustrated on FIG. 1 is a duct 26 for evacuating a residual gas W (impure nitrogen) starting from the lower level of injection of poor liquid of column 2, and a duct 27 for evacuating pure low pressure nitrogen starting from the top of the minaret 3, ducts 26 and 27 passing through the sub-cooler mentioned above to ensure the cooling thereof, and through the exchange line 7 from the cold end to the hot end.

The cold content of the arrangement is ensured by expansion at low pressure of a portion of the entering air, partially cooled, in turbine 8, and blowing of this expanded air in column 2 via duct 28.

The alternating system which depends on the storage containers 5 and 6 will now be described, by assuming that the demand of high pressure gaseous oxygen is different from its nominal or mean value, the flow of air treated remaining constant.

(a) When the demand of gaseous oxygen is low (operation OL), the lack of gaseous oxygen withdrawn from the column 2 as compared to the nominal operation is sent in liquid form from the vat of the column 2 to the storage container 5, which is substantially at atmospheric pressure, by means of pump 29 and via duct 30.

To compensate for the resulting loss of refrigerating value in the double column, liquid nitrogen is sent from the storage container 6, which is substantially at atmospheric pressure, to the top of the minaret 3 by means of pump 31 and via duct 32, in an amount which is about 20% higher than the quantity of liquid oxygen which is sent to the storage container 5. This nitrogen is recovered in gaseous form at the top of minaret 3, so that an excess of gaseous products is entirely sent to the cold end of exchange line 7 as compared to the nominal operation.

This excess of refrigerating products is used to produce additional liquid, in the following manner.

An excess of gaseous oxygen with respect to the demand, is withdrawn from column 2 via duct 20, and in order to equilibrate the balance of material in column 2, the flow of liquid oxygen sent to the storage container 5 is reduced in a corresponding manner. The same excess of gaseous oxygen, after compression, is sent to the hot end of the exchange line, via duct 33 starting from the backflow of compressor 21, it is liquified in the exchange line after which it is sent to the storage container 5 from the cold end of the latter, via duct 34 which is provided with a pressure release valve 34A.

In all, the storage container 5 receives the same quantity of liquid oxygen as in a known alternater system, but with less bleeding from the vat of column 2. A corresponding quantity of liquid nitrogen from the storage container 6 is thus saved during the operation OL.

On the other hand, injection of additional hot gas (high pressure oxygen) in the exchange line results in a rise of the suction temperature of the turbine 8, for example to a value corresponding to the nominal operation, and consequently in an increase of its specific refrigerating power. This enables to still substantially increase the production of liquid, by simultaneously increasing the flow of turbined air, the yield of extraction of argon, in this operation, being near the asymptote and consequently not very sensitive to this turbined flow.

(b) When the demand of gaseous oxygen is high (operation NL), compressor 21 operates without recycling via duct 22, all the compressed oxygen being supplied to the arrangement. The excess of gaseous oxygen withdrawn from column 2 as compared to the nominal operation is compensated by an injection of liquid oxygen in the vat portion of this column starting from storage container 5, via duct 35, pump 29 and duct 36.

The refrigerating balance is equilibrated by sending liquid nitrogen from the top of column 1 to the storage container 6 via duct 11 and duct 37 provided with pressure release valve 38.

However, in this operation, the reserve of liquid nitrogen which is obtained in operation OL by liquifying high pressure oxygen is utilised by sending a corresponding flow of liquid nitrogen at the top of minaret 3, via duct 32. This additional refrigerating input enables to correspondingly reduce the flow of turbined air and moreover produces additional reflux in column 2, which constitutes two factors promoting low pressure distillation. In all, the yield of extraction of argon is increased in operation NL.

The increased yield of argon extraction which is thus obtained in operation NL is clearly higher than the decrease of yield of extraction of argon during operation OL. In all, the average yield of extraction of argon is increased substantially.

It must be noted that the energy gain obtained by the invention may be utilised not only to increase the yield of extraction of argon, but also to increase the liquid (liquid oxygen or liquid nitrogen) production of the arrangement.

It will be understood that the invention not only applies to arrangements which are maintained cold by low pressure air expansion, also to all the other types of arrangements for the distillation of air with a double column.

We claim:

1. An air distillation process for producing a variable amount of oxygen in a double column apparatus in which compressed air cooled in a heat exchange line is fed to a high pressure column, and gaseous and liquid oxygen are produced in a low pressure column, comprising the steps of:

a) when oxygen demand is low, supplying liquid oxygen from said low pressure column to an oxygen tank, supplying additional liquid oxygen to said oxygen tank by cooling compressed gaseous oxygen in the heat exchange line, and reducing liquid nitrogen flow from a nitrogen tank to said low pressure column; and b) when oxygen demand is high, supplying liquid oxygen from said oxygen tank to said low pressure column, condensing a corresponding amount of nitrogen from said high pressure column, and supplying the condensed nitrogen to the nitrogen tank.

2. The process of claim 1, wherein the liquid nitrogen from said nitrogen tank supplied to said low pressure column when oxygen demand is high substantially corresponds to the amount of nitrogen saved when oxygen demand is low.

3. The process of claim 2, wherein fluid cooling of said low pressure column is reduced when oxygen demand is high.

4. The process of claim 3, wherein the fluid cooling is achieved by turbining a portion of the compressed air feed.

5. The process of claim 1, wherein fluid cooling of the low pressure column is increased when oxygen demand is low.

6. The process of claim 5, wherein the fluid cooling is achieved by turbining a portion of the compressed air feed.

7. An air distillation apparatus for producing a variable amount of oxygen, comprising a double column fed by compressed air feed means and supplying gaseous oxygen under pressure to an oxygen production duct, the air feed means and oxygen production duct passing through a heat exchange line in opposite directions, a liquid oxygen tank and a liquid nitrogen tank operatively connected to the double column, and a return conduit leading from the oxygen production duct to the liquid oxygen tank via the heat exchange line, so as to selectively supply the liquid oxygen tank with additional liquid oxygen.

8. The apparatus of claim 7, further comprising a cooling fluid circuit comprising a turbine.

9. The apparatus of claim 8, wherein the cooling fluid circuit is derived from the compressed air feed means.

* * * * *